United States Patent [19]

Ballard

[11] Patent Number: 4,704,809

[45] Date of Patent: Nov. 10, 1987

[54] GOLF SHOE

[76] Inventor: Paul S. Ballard, 4906 Carrollwood Meadows Dr., Tampa, Fla. 33625

[21] Appl. No.: 6,172

[22] Filed: Jan. 23, 1987

Related U.S. Application Data

[63] Continuation-in-part of Ser. No. 867,202, May 27, 1986, abandoned.

[51] Int. Cl.[4] ..... A43B 5/00; A43C 15/00; A63B 69/36

[52] U.S. Cl. ..... 36/127; 36/134; 273/32 C; 273/187 B

[58] Field of Search ..... 36/127, 134; 273/32 C, 273/187 B

[56] References Cited

U.S. PATENT DOCUMENTS

| | | | |
|---|---|---|---|
| 2,616,190 | 11/1952 | Darby . | |
| 2,847,769 | 8/1958 | Schlesinger . | |
| 2,855,704 | 10/1958 | Schlesinger . | |
| 2,959,874 | 11/1960 | Schlesinger | 36/127 X |
| 3,789,523 | 2/1974 | Rubin | 36/127 |
| 4,118,034 | 10/1978 | O'Brien . | |
| 4,161,829 | 7/1979 | Wayser . | |
| 4,180,924 | 1/1980 | Subotnick . | |
| 4,524,531 | 6/1985 | VanDeripe | 36/127 |

FOREIGN PATENT DOCUMENTS

| | | | |
|---|---|---|---|
| 1141593 | 3/1957 | France | 36/127 |

*Primary Examiner*—James Kee Chi

*Attorney, Agent, or Firm*—Stevens, Davis, Miller & Mosher

[57] ABSTRACT

An improved golf shoe construction for assisting the golfer to maintain a proper position and weight distribution when worn during a golf swing. The improvement is defined by a wedge-shaped sole and heel bottom for the shoe, with the height of the wedge being greatest along the shoe edge defining the outside of the wearer's body. The improved, wedge-shaped sole and heel may also be incorporated into each shoe defining a pair of golf shoes.

12 Claims, 5 Drawing Figures

GOLF SHOE

Related Applications

This application is a continuation-in-part of my copending application Ser. No. 867,202, filed May 27, 1986, which is now abandoned.

BACKGROUND OF THE INVENTION

1. Field of Invention

The present invention relates to an improved golf shoe for assisting the golfer to maintain proper weight distribution when the shoe is worn during a golf swing. The improvement of this invention comprises forming both the sole and the heel of the shoe to define a substantially wedge-shaped transverse cross section with respect to the longitudinal dimension of the shoe defined from the toe to the heel. The height of the wedged sole and heel is greatest along the side of the shoe defining the outside of the golfer's body. Each shoe comprising a pair of golf shoes may be similarly wedged.

2. Description of the Prior Art

Given the extreme popularlity of the game of golf, not only in the United States but also throughout the world, it is not surprising that an extremely large number of devices which might be referred to as "golfing aids" have been developed and made available to golfers. While such golfing aids take many forms, other than golf clubs and golf balls, perhaps the greatest attention has been devoted to golf shoes. This really is not surprising, for one often hears it said of a golfer that they really have a "sweet swing," or that their swing is really "in the groove." In similar fashion, when a golfer hits a bad shot, the excuse often states is that they "pulled away" or "moved off the ball" during the swing.

Of course, proper foot placement, stability of stance, and proper weight distribution are all-important to achieving a consistent golf swing which is always in the groove. For this reason, numerous modifications have been proposed and patented for golf shoe constructions directed at improving and stabilizing the golfer's stance during the golf swing.

One such device is disclosed in U.S. Pat. No. 4,118,034 to O'Brien titled "Golfer's Stance Block." That patent teaches the use of a training device that may be removably affixed to the bottom of a conventional shoe. The training device is a wedge-shaped block, or clip, which is attached to the shoe bottom. The wedge is constructed so that it is highest on the relative outside of the shoe, and the patent teaches use of this training device on the golfer's rear foot. It is understood that the term "rear foot" means the foot opposite the intended direction of flight of the golf ball. The device of the O'Brien patent is not intended for use with standard, spiked golf shoes, and is totally in the nature of a training device. It does cant the golfer's rear foot inwardly, but it would appear to provide a relatively unstable support, for the block does not cover the entire sole of the shoe.

In 1974, U.S. Pat. No. 3,789,523 entitled "Golf Shoe" issued to Rubin. A golf shoe construction is provided wherein the sole of the shoe is thicker along the outside edge than along the inside edge. No modification of the heel of the Rubin shoe is discussed. In order to permit relatively level, or normal, walking on a hard surface, this patent describes and claims the use of golf spikes of differing length so that when worn on a hard surface, the plane defined by the distal end of each spike will be relatively horizontal. U.S. Pat. Nos. 2,847,769 and 2,855,704 are both to Schlesinger and are both titled "Shoes for Golfers." Both patents describe and claim shoe constructions intended to assist the golfer in maintaining a proper stance over the ball during a golf swing. According to the U.S. Pat. No. 2,847,769 the outside of the sole portion of the shoe worn on the golfer's rear foot is substantially thicker than either the inside portion of the heel portion of the shoe. According to the disclosure of the '704 patent, the sole of the golf shoe is substantially flat, but the inside of the heel of the shoe is of a reduced thickness.

U.S. Pat. No. 4,161,829 to Wayser relates to a pair of golf shoes. According to the disclosure of that patent, the outer edge of the sole of the left shoe is relieved, and the inner edge of the sole of the right shoe is relieved. That construction is, of course, for a right-handed player and would be reversed for a left-handed player according to the patent.

Two other U.S. patents relating to shoe constructions are also worthy of mention. U.S. Pat. No. 2,616,190 to Darby discloses footwear for correcting a person's walking angle wherein the inside of a shoe is thicker, or elevated, with respect to the shoe outside edge. A somewhat similar raising of the inside edges of a pair of shoes is taught in U.S. Pat. No. 4,180,924 to Subotnick and assigned to Brooks Shoe Manufacturing Co., Inc.

Thus, while it is clear that efforts have been made for the purpose of assisting a golfer to maintain a proper golf stance during the golf swing by modifying the bottom surface of one or both shoes comprising a pair of golf shoes, it is just as evident that the search for such a shoe or pair of shoes continues. It is therefore apparent that substantial need remains for an improved golf shoe which comfortably and efficiently assists in the maintenance of proper weight distribution when worn during a golf swing.

SUMMARY OF THE INVENTION

The present invention relates to an improved golf shoe for assisting in the maintenance of proper weight distribution when worn during a golf swing, that is to keep a golfer's weight on the balls of his feet when swinging the club. In this context the "balls of the feet" means the area on each foot which is immediately inwardly of the base of the big toe.

While the invention will be described and explained primarily in terms of one shoe, it is to be understood that both shoes comprising the pair may be improved in accordance with the structure of this invention. Furthermore, while the invention will be described in terms of structural modifications to the shoe sole and the shoe heel, the structure resulting in the improved golf shoe may be utilized in both shoes having distinct sole and heel portions as well as shoes having a continuous, or unitary sole and heel. Of course, there is no intended limitation with respect to whether the golfer wearing the improved shoe of this invention is either male or female. Finally, the improved golf shoe of this invention may be utilized in combination with both spiked golf shoes and golf shoes having no spikes.

Simply stated, the improved golf shoe of this invention comprises a thicker sole and heel on the outer edge of each shoe, preferably a first wedge-shaped member between the sub-sole and the outer sole of the golf shoe and a second wedge-shaped member between the sub-sole and the heel of the golf shoe. Of course, it is not necessary that a separate wedge member be used; the outside edge of the sole and heel, for example, in the case of a molded rubber sole and heel or one of man-made material, can be made thicker. The configuration of both the first and second wedges is such that a cross-sectional view taken substantially perpendicular to the longitudinal dimension of the shoe will show that the wedge is thinest at about the longitudinal centerline and is highest along the outside shoe edge. The result is that the outside edge of the shoe sole and heel are relatively thicker than the corresponding inside edges; the slope of the wedge is substantially linear. The or each wedge preferably extends along the entire length of the shoe from about the longitudinal centerline of the shoe to the outer edge thereof, that is, it is one-half or less of the width of the shoe.

When only a single one of the shoes constituting a pair is to be modified in accord with this invention, it is the golfer's rearmost shoe which is improved. That is to say, for right-handed golfers, the right shoe would be modified. Conversely, for left-handed golfers, the left shoe would be modified. As indicated above, however, both shoes of a single pair may be modified in accord with the teaching of this invention.

When the improved golf shoe is constructed to include standard spikes, it is proposed that truly "standard" spikes would be utilized. That is to say, neither the presence nor absence of golf spikes is intended to limit the scope of this invention, and there is no intent of limiting the invention by the particular type or placement of spikes. It is contemplated that standard spikes removably attached to the bottom of the shoe according to standard procedures and construction would be utilized.

The functional result of the improved golf shoe of this invention is to elevate the outermost edge of the golfer's rear-most foot upon assuming the proper stance for striking the golf ball. The improved golf shoe construction will cause the golfer's weight to shift inwardly and forwardly to the balls of the feet. Actual utilization of shoes constructed in accord with this invention has confirmed that this concentration of weight toward the balls of the golfer's feet significantly reduces the tendency of the golfer to pull away from the ball during the golf swing. The attendant results are normally a more consistent swing and greater accuracy. The thicker sole on the edge also prevents a golfer from rolling over on the outside of his foot and thus losing his balance and moving his head off the golf ball. Preferably the outer edge of the heel is elevated slightly more than the outer edge of the sole to insure that weight is shifted to the balls of the feet.

The invention accordingly comprises an article of manufacture possessing the features, properties and the relation of elements which will be exemplified in the article hereinafter described, and the scope of the invention is indicated by the claims and all constructions falling thereunder.

BRIEF DESCRIPTION OF THE DRAWINGS

For a more complete understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
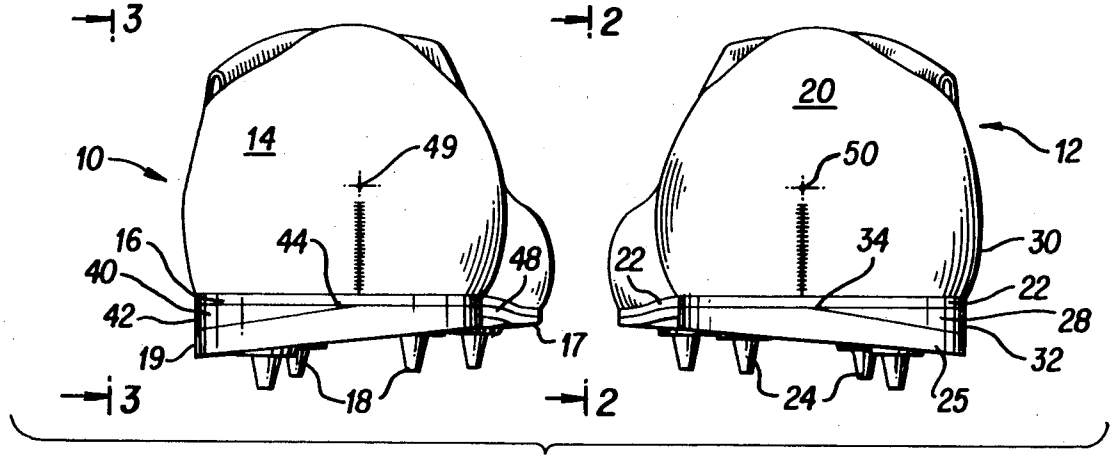
FIG. 1 is a rear elevational view of a pair of improved golf shoes.

A pair of improved golf shoes constructed pursuant to the present invention is illustrated in the view of FIG. 1. The improved left shoe is generally indicated as 10, and the improved right shoe is generally indicated as 12. A side view of left shoe 10 is presented in FIG. 3, and a side view of right shoe 12 is presented in FIG. 2. As shown in the drawings, both shoes 10 and 12 are of relatively "standard" construction except for the improvement of this invention and comprise, with specific regard to left shoe 10, and upper portion 14, a subsole 16 an outer sole 17 and a plurality of spikes 18. Right shoe 12 is similarly constructed to include an upper portion 20, a subsole 22, an outer sole 23 and a plurality of spikes 24.

Figure 2:
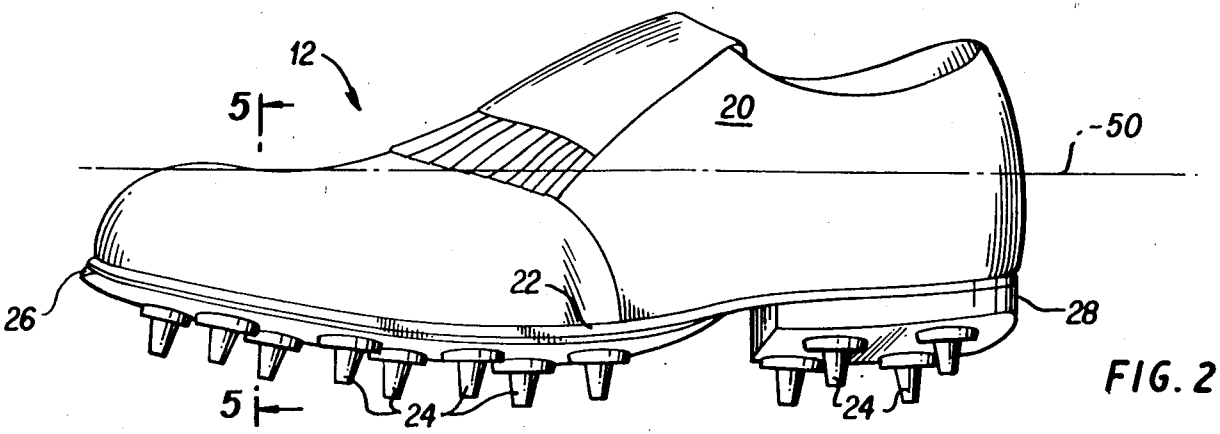
FIG. 2 is a side elevational view taken along line 2—2 of FIG. 1.
Figure 5:
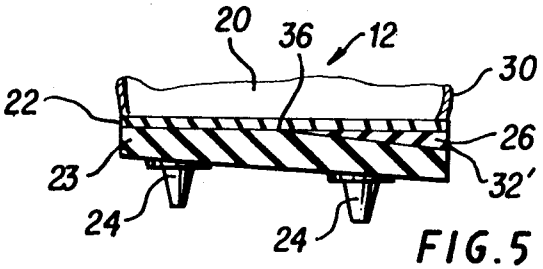
FIG. 5 is a sectional view taken along line 5—5 of FIG. 2 showing the sole portion of the right shoe in cross section.

Referring initially to right shoe 12 as shown in FIGS. 1 and 2, the improvement of this invention comprises a first substantially wedge-shaped member 26 between the subsole 22 and the outer sole 23 of shoe 12, and a second substantially wedge-shaped member 28 between the subsole 22 and the heel 25 of shoe 12. As clearly seen in the views of FIGS. 1 and 2, the height, or vertical thickness, of both wedge members 26 and 28 is greatest adjacent outside edge 30 of shoe 12 and at a minimum near the center of the width of the shoe along the longitudinal center line 50. That is to say, referring to the view of FIG. 1, the height of outside 32 of second member 28 is greater than the inside 34 of second member 28. As shown in FIG. 5 the corresponding height of the outside 32' of first wedge member 26 is also greater than the height of the inside 36 of member 26 and, preferably, is slightly greater or substantially equal to the outside height 32 of heel wedge 28.

By virtue of this improved construction of shoe 12, when worn by a right-handed golfer upon addressing a golf ball to be hit, the golfer's weight will be shifted toward the ball of his right foot. This necessarily means that the golfer's weight will be concentrated for proper balance and there will be less tendency to pull away from the ball during the course of the golf swing. Also, the thicker outer edge prevents a golfer from rolling over onto the outside of his foot, thus losing his balance and moving his eyes off the golf ball.

Figure 3:
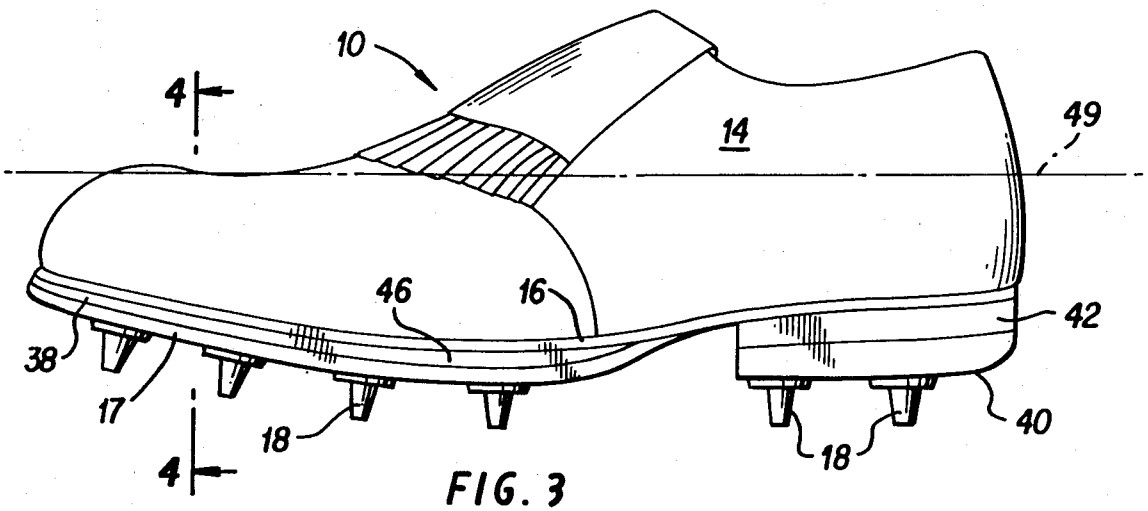
FIG. 3 is a side elevational view taken along line 3—3 of FIG. 1.
Figure 4:
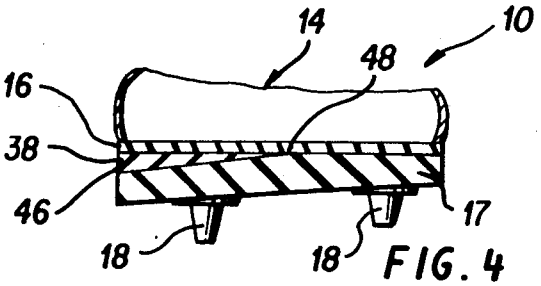
FIG. 4 is a sectional view taken along line 4—4 of FIG. 3 showing the sole portion of the left shoe in cross section.

Referring now to the left shoe 10 as shown in FIGS. 1, 3 and 4, it is apparent that the improved construction for shoe 10 is simply a mirror image of shoe 12. Improved shoe 10 comprises a first wedge-shaped member 38 between the subsole 16, the outer sole 17 of shoe 10 and a second wedge-shaped member 40 between the subsole 16 and left heel 19. The height of outside 42 of second wedge member 40 is greater than the height of its inside 44. Similarly, the height of outside 46 of left sole wedge 38 is greater than the height of its inside 48 and both wedges 38 and 40 are at a minimum near the center of the width of the shoe along the longitudinal center line 49. Accordingly, when worn by a left-handed golfer, the improved shoe 10 will shift the golfer's weight toward the ball of his left foot upon assuming a proper stance for addressing a golf ball.

As previously indicated, some golfers may wish to wear a pair of golf shoes wherein both shoes have been improved pursuant to the construction of this invention. Such use of a pair of improved golf shoes has been tested and found to be quite useful. It should also be noted that while the pair of shoes 10 and 12 shown in the drawing figures are depicted as including separate sole and heel elements, the scope of this invention is not to be limited thereto. That is to say, first and second wedge members 38 and 40 of the shoe 10 as well as corresponding first and second wedge members 26 and 28 of shoe 12 could be unitary. Finally, and for purposes of illustration only, it has been determined that a preferred height for the outside of first members 26 and 38 as well as for second members 28 and 40 is about ½ inch more than the height of their corresponding insides.

It will thus be seen that the objects set forth above, among those made apparent from the preceding description, are efficiently attained, and since certain changes may be made in the above article without departing from the scope of the invention, it is intended that all matter contained in the above description are shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An improved golf shoe for assisting in the maintenance of proper weight distribution and shifting weight to the balls of the feet when worn during a golf swing, the improvement comprising:

a first wedge-shaped member carried by the sole of the golf shoe and a second wedge-shaped member carried by the heel of the golf shoe wherein the height of said first and second members is greatest along the edge of the shoe opposite the intended direction of travel of the golf ball to be struck and the wedge-shaped member extends across one-half or less of the width of the shoe from the center thereof to the outside edge of the shoe.

2. An improved golf shoe as in claim 1, wherein said greatest heights of said first wedge-shaped member and said second wedge-shaped member are substantially equal.

3. An improved golf shoe as in claim 1, wherein the height of the second wedge-shaped member is greater than said first wedge-shaped member.

4. An improved golf shoe as in claim 1, wherein said greatest height of said wedge-shaped member is about one-half inch more than their heights at the center of the shoe.

5. The shoe of claim 1, having a subsole, an outer sole and a heel and wherein the first wedge-shaped member is between the subsole and the outer sole and the second wedge-shaped member is between the subsole and the heel.

6. The shoe of claim 1, in which at least one of said first and second wedge-shaped members is integral with its respective sole or heel.

7. An improved pair of golf shoes for assisting in the maintenance of proper weight distribution and shifting the weight to the balls of the feet when worn during a golf swing, the improvement comprising:

a first wedge-shaped member carried by the sole of each shoe and a second wedge-shaped member carried by the heel of each shoe wherein the heights of said first and second members is greatest along the edge of each shoe defining the outside of the wearer's body and the wedge-shaped member extends across one-half or less of the width of the shoe from the center thereof to the outside edge of each shoe.

8. An improved pair of golf shoes as in claim 4, wherein said greatest heights of said first members and said second members are substantially equal.

9. The pair of shoes of claim 7, each shoe having a subsole, an outer sole and a heel and wherein the first wedge-shaped member is between the subsole and the outer sole and the second wedge-member is between the subsole and the heel.

10. The improved pair of golf shoes as in claim 8, wherein said greatest height is about one-half inch more than the height along the center of each shoe.

11. An improved pair of shoes as in claim 7 wherein in each shoe has at least one of said first and second wedge-shaped members integral with its respective sole or heel.

12. An improved pair of shoes as in claim 7, wherein the height of the second wedge-shaped member is greater than said first wedge-shaped member.

* * * * *